United States Patent [19]

Kerr et al.

[11] 4,060,810

[45] Nov. 29, 1977

[54] LOADED MICROSTRIP ANTENNA

[75] Inventors: John L. Kerr, Neptune; Michael J. Timochko, Lanoka Harbor, both of N.J.

[73] Assignee: The United States of America as represented by the Secretary of the Army, Washington, D.C.

[21] Appl. No.: 729,513

[22] Filed: Oct. 4, 1976

[51] Int. Cl.[2] ..... H01Q 1/38

[52] U.S. Cl. ..... 343/700 MS; 343/725; 343/846

[58] Field of Search ..... 343/700 MS, 846, 725, 343/830

[56] References Cited

U.S. PATENT DOCUMENTS 3,778,717 12/1973 Okoshi et al. ..... 343/775

*Primary Examiner*—Eli Lieberman

*Attorney, Agent, or Firm*—Nathan Edelberg; Jeremiah G. Murray; Bernard Franz

[57] ABSTRACT

A microstrip antenna design according to which the resonant frequency can be substantially reduced for a given size radiator, or to which the size of the radiator can be reduced for a given resonant frequency. As will be seen, a microstrip antenna loading is accomplished through the removal of a central portion of the etched metal radiator, and the amount of loading is a function of the size of the central portion removed.

10 Claims, 4 Drawing Figures

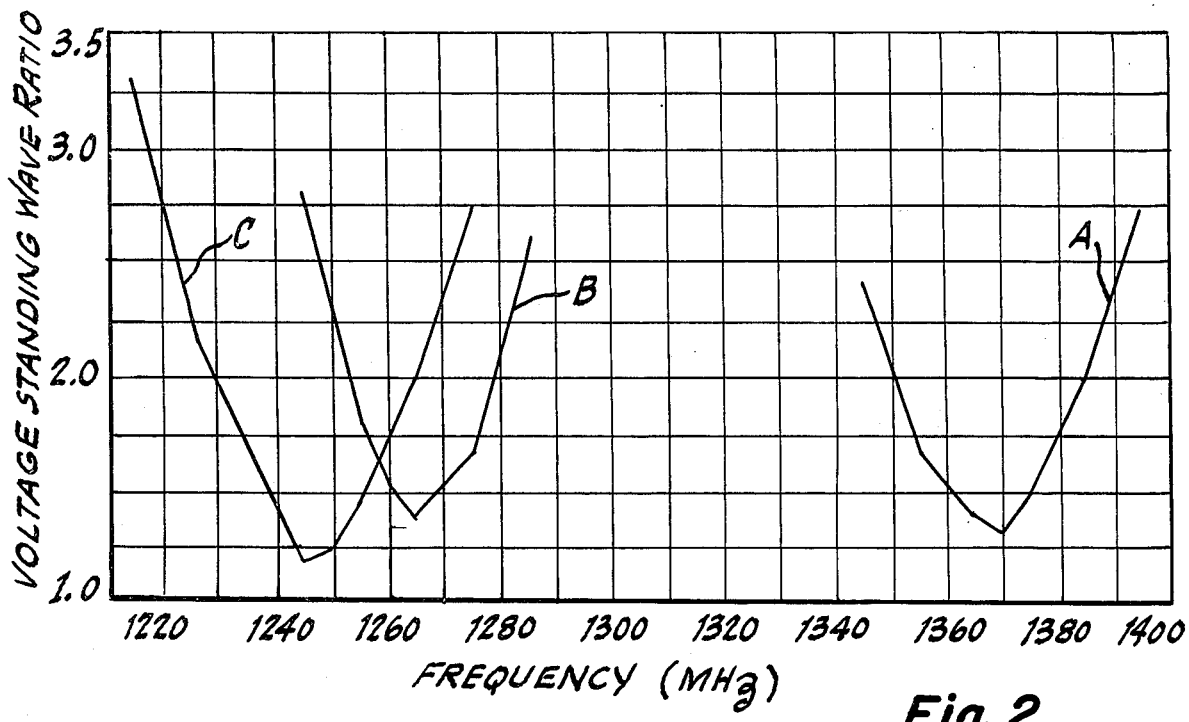
Fig. 2.
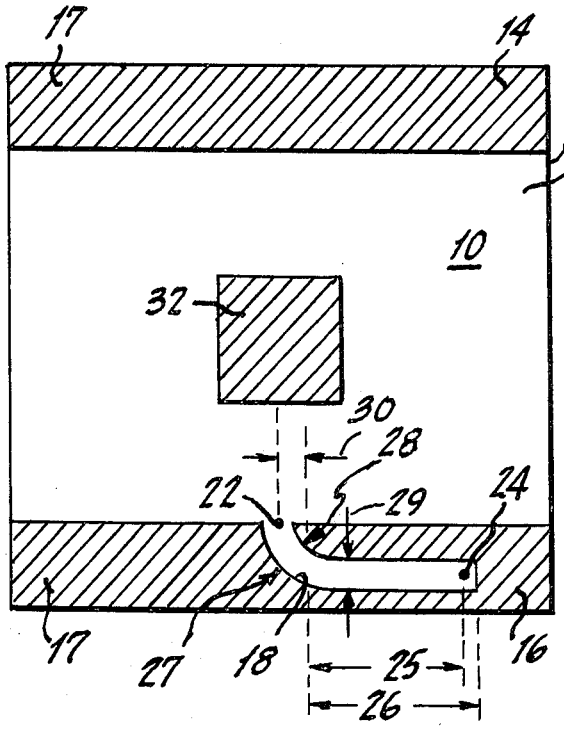
Fig. 1.
Fig. 3.
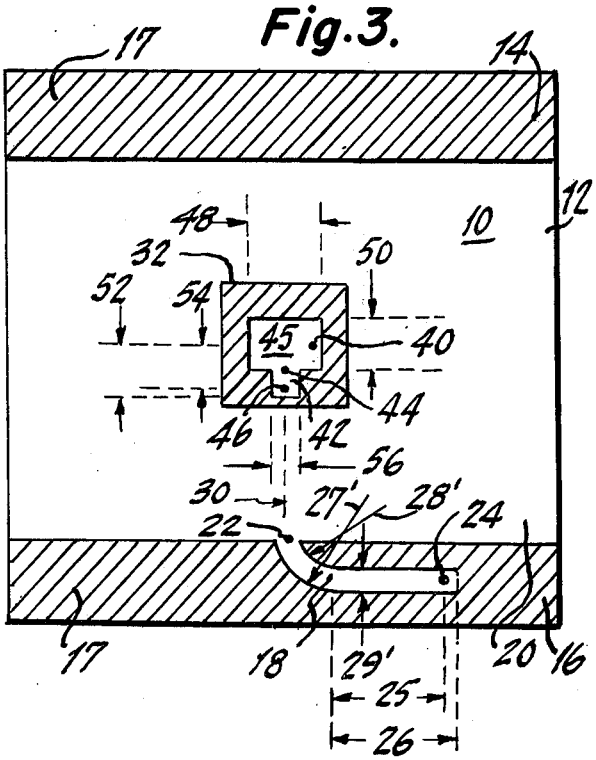
Fig. 4.
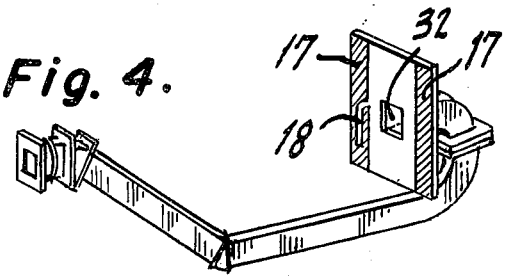

LOADED MICROSTRIP ANTENNA

The invention described herein may be manufactured and used by or for the Government for governmental purposes without the payment of any royalties thereon or therefor.

FIELD OF THE INVENTION

This invention relates to microstrip antennas and, more particularly, to an antenna design which simplifies the construction of dual or multifrequency antennas combining microstrip antenna and other radiator design techniques.

BACKGROUND OF THE INVENTION

As is well known and understood, a microstrip antenna is a printed circuit device in which the radiating element is typically a rectangular patch of metal etched on one side of a dual-clad circuit board. As is also well known and understood, the size of the element is dependent upon the resonant frequency desired and upon the dielectric constant of the circuit board material. In those instances where it is desired to combine antennas operating at the L-band of frequencies with a horn radiator operating at the X-band of frequencies — for a parabolic dish reflector, for example — the resultant construction can lead to a reduced efficiency of operation because of aperture blockage, unless the reflector is increased in size. This, however, makes the combination fairly cumbersome and increases its manufacturing costs.

SUMMARY OF THE INVENTION

As will become clear hereinafter, the microstrip antenna design of the invention follows from a finding that the resonant frequency of a given size radiator decreases if a central portion of the etched metal element is removed. With the additional finding that the size of the radiator could be reduced and yet still operate at the same resonant frequency, simplifications in microstrip antenna designs can be made — including the fabrication of a dual frequency antenna in which the microstrip element operates at L-band while an X-band radiator operates through a hole in the center of the dual-clad circuit board. By thus being able to reduce the size of the microstrip antenna for a given frequency, the overall antenna feed can be reduced in dimension, so as to enable the dish reflector, for example, to be similarly decreased in size, while maintaining the same degree of aperture blockage.

Besides thus permitting the construction of a dual frequency configuration in which one radiator illuminates through a central hole in the dual-clad circuit board, the loaded microstrip antenna of the invention permits the printing of a higher frequency microstrip antenna on the same dual-clad circuit board, to serve as the radiator which previously illuminated through the central hole. As will be readily apparent to those skilled in the art, these techniques are applicable not only to dual-frequency arrangements, but to multiple frequency capability arrangements, as well.

BRIEF DESCRIPTION OF THE DRAWING

These and other features of the present invention will be more clearly understood from a consideration of the following description, taken in connection with the accompanying drawing, in which:

FIG. 1 shows a loaded microstrip antenna constructed in accordance with the invention;

FIG. 2 is a series of curves showing resonant frequency characteristics as exemplified by microstrip antennas constructed in accordance with the present invention; and FIG. 3 is a dual-frequency microstrip antenna illustrating the concepts described herein.

DETAILED DESCRIPTION OF THE DRAWING

In FIG. 1, the microstrip antenna 10 is shown as comprising a circuit board 12, the back side of which (not shown) is clad entirely of a metal material, typically copper. In conventional constructions, the front side of the circuit board is clad of like material, except in the areas 14 and 16, where the metal is etched away to reveal the dielectric material 17 underneath. (In the preferred embodiments of the invention described, dielectric materials available under the tradenames Polyguide and Duroid were employed.) A section of metal 18 extends from the rectangular metal patch 20 so formed, to operate as a microstrip transformer in matching the impedance at the input to the patch 22 to the impedance at the signal input jack 24, usually the output from a coaxial cable coupled through the back side of the circuit board 12.

In one embodiment of the microstrip antenna invention, a circuit board clad with copper 1½ mils thick overlying a ⅛ inch thick Duroid dielectric was employed for radiating in the L-band of frequencies. When constructed 4.655 inches on a side, and with the etched areas 14, 16 extending approximately 0.988 inches each, the microstrip antenna of FIG. 1 exhibited a resonant frequency of some 1370 MHz, and exhibited a resonant frequency characteristic as shown by the curve A in FIG. 2. The dimensions of the microstrip transformer 18, illustrated by the reference numerals 25 – 30, were as follows:

Length 25 . . . 0.772 inches
Length 26 . . . 0.872 inches
Arc 27 . . . 0.600 inch radius
Arc 28 . . . 0.400 inch radius
Width 29 . . . 0.200 inches
Distance 30 . . . 0.500 inches, measured with respect to the vertical center line of the circuit board 12.

In accordance with the present invention, however, we have found that the resonant frequency of this described radiator decreases if a central portion of the rectangular metal patch 20 is removed. For example, we have found that if a 1-inch square area were removed at the center of the circuit board 12, the resonant frequency is lowered by slightly in excess of 9%, as compared with an unloaded microstrip antenna. We have further found that if this central area, shown as 32 in FIG. 1, were so removed as to include the dielectric material beneath it and the copper cladding on the back side of the board 12 as well (thereby resulting in a 1-inch square hole completely through the circuit board 12), then the resonant frequency of the microstrip antenna is lowered by approximately another 1%. The resonant frequency characteristic for these modifications is shown by the curves B and C in FIG. 2, wherein the resonant frequency has been reduced to approximately 1270 MHz and 1250 MHz, respectively. When the embodiment of FIG. 1 was modified to provide a 2-inch square hole completely through the circuit board 12, the resonant frequency of the microstrip antenna was observed to decrease by approximately 21% — continuing, however, as with all of these decreases, to exhibit substantially the same unchanged bandwidth.

As will be readily apparent, this loaded microstrip antenna design makes possible a substantial reduction in the size of the rectangular metal patch 20 required for a given resonant frequency. For example, we have found that the 9% decrease in resonant frequency by using a 1-inch square area of removed metal 32 can be offset by reducing the height between the areas 14, 16 by some 12%. This reduced size for the loaded microstrip antenna, as compared to the unmodified version, offers advantages that will be readily apparent. In one instance, we have found that a parabolic reflector as small as three feet in diameter could be illuminated at frequencies below 1100 MHz, yet with very little degradation due to aperture blockage. Additionally, the reduced size provides additional space for feed lines in a planar array antenna configuration.

In addition to the advantages of lowered resonant frequency for a given size and reduced size for a given resonant frequency, the loaded microstrip antenna makes possible new embodiments. One example of a dual frequency loaded microstrip antenna is illustrated in FIG. 3, as showing an X-band microstrip antenna 40 in which the rectangular metal patch 45 is printed onto the 1-inch square loading patch 32 of the L-band microstrip antenna of FIG. 1. In this embodiment of the invention, all dimensions are the same as with respect to FIG. 1, except that the dielectric is selected of 1/16 inch thickness instead of ⅛ inch thickness. This follows from the finding that the X-band radiator requires a thinner dielectric board in order to operate at the higher X-band frequencies, such as 9500 MHz. In this case, then, the L-band microstrip antenna will be more narrow band in operation. The impedance transformer for the X-band radiator is shown at 42, to match the impedance at the input point 44 of the patch 40 to the impedance of the coaxial cable which applies its signal via the back of the same dualclad board 12, by way of terminal 46. In this embodiment, the length of the radiator 40 is represented by the reference numeral 48, its width by the reference numeral 50, and with reference numerals 52, 54 and 56 illustrating other selected dimensions for X-band operation. In the actual construction of a 9500 MHz radiator, the following dimensions were employed:

Length 48 . . . 0.610 inches
Width 50 . . . 0.400 inches
Dimension 52 . . . 0.450 inches
Dimension 54 . . . 0.405 inches
Dimension 56 . . . 0.070 inches (equi-distant about the vertical axis of the L and X-band radiators)
Arc 27′ . . . 0.535 inch radius
Arc 28′ . . . 0.465 inch radius
Width 29′ . . . 0.070 inches.

Two other points should be noted with respect to the FIG. 3 embodiment. First, although like polarization is illustrated, orthogonal polarization can be obtained by etching the X-band radiator to be rotated 90° on the 1-inch square patch 32. Secondly, the impedance transformer 42 can be curved, as the impedance transformer 18, although the orientation selected is concerned primarily only with keeping the extension physically on the circuit board employed.

On the other hand, if the dual band system requirements dictate the use of an L-band antenna of wider bandwidth, then a possible alternative approach would be to fabricate the L-band microstrip antenna on its ⅛ inch thick circuit board, and employing the square hole technique of FIG. 1 through which an X-band horn might radiate (as illustrated in the inset below FIG. 4). One such configuration has been successfully implemented in accordance with the invention, utilizing an X-band horn having an aperture of 0.9 inch square radiating through the 1-inch square hole of an L-band loaded microstrip radiator. A second approach might be to print the higher frequency, X-band microstrip antenna on its own small circuit board — with its reduced thickness —, and then fitting it such that the dielectric surround on the front of the X-band radiator bears against the copper ground plane at the back side of the L-band antenna of greater board thickness, and such that the X-band antenna can radiate through the hole in the L-band antenna. In this instance, each radiator would be printed on its own dual-clad board having its own input jack, as compared to the configuration of FIG. 3 where both the X radiator and the L-band radiator share the same circuit board.

While there have been described what are considered to be preferred embodiments of the present invention, it will be readily apparent to those skilled in the art that modifications may be made without departing from the teachings herein of providing a means for substantially lowering the resonant frequency of a given size radiator or reducing the size of a radiator required for a given resonant frequency through the removal of a central portion of the etched metal radiator. For example, although the present invention has been described with respect to the removal of a square portion from the central area of the radiator patch, testing has shown that round or other configured portions can be removed as well, and still provide the operation described herein. For at least such reasons, therefore, reference should be had to the claims appended hereto in determining the scope of the invention.

We claim:

1. In a microstrip antenna, apparatus comprising:
a circuit board of dielectric material having a metallic ground plane on one side thereof; and
a radiating element in the form of a patch of metal etched on the opposite side of said board;
a microstrip transformer etched on said opposite side of said board continuous with said patch at the center of one side for coupling a transmission line and matching impedance to the patch; said patch being continuous thereacross except for the removal of a relatively large portion in the central region thereof, so that current flow across the patch is forced to deviate around the area of removal and therefore have a longer path, which lowers the resonant frequency of radiation.

2. The apparatus of claim 1 wherein the patch portion removed is substantially square in cross section.

3. In a microstrip antenna, apparatus comprising:
a circuit board of dielectric material having a metallic ground plane on one side thereof; and
a radiating element in the form of a patch of metal etched on the opposite side of said board, said patch being continuous thereacross except for the removal of a portion in the central region thereof;
wherein said circuit board and metallic ground plane are also continuous, except for the removal of a portion thereof substantially coextensive with the removal of said patch portion etched thereupon.

4. The apparatus of claim 3 wherein the patch portion, circuit board portion and ground plane portion removed are each substantially square in cross section.

5. The apparatus of claim 3 wherein there is additionally included a second circuit board of dielectric material and a second radiating element in the form of a patch of metal etched on one side thereof, and wherein said second circuit board is affixed to said one side of said first circuit board and in a manner to align said second radiating element with the portion of said first circuit board and said metallic ground plane removed.

6. The apparatus of claim 5 wherein said second circuit board of dielectric material is thinner than said first circuit board of dielectric material.

7. The apparatus of claim 3 wherein there is additionally included a second radiating element in the form of a horn affixed to said one side of said circuit board and in a manner to align said second radiating element with the portion of said circuit board and said metallic ground plane removed.

8. In a microstrip antenna, apparatus comprising:

a circuit board of dielectric material having a metallic ground plane on one side thereof; and a radiating element in the form of a patch of metal etched on the opposite side of said board, said patch being continuous thereacross except for the removal of a portion in the central region thereof;

wherein there is additionally included a second, different radiating element in the form of a patch of metal superimposed on said opposite side of said circuit board in the region of removal of a portion of said first radiating element.

9. The apparatus of claim 8 wherein said first and second metal patches are oriented to provide like polarizations of signals radiated thereby.

10. The apparatus of claim 8 wherein said first and second metal patches are oriented to provide orthogonal polarizations of signals radiated thereby.

* * * * *